US007770538B2

(12) United States Patent
Dahlgren

(10) Patent No.: US 7,770,538 B2
(45) Date of Patent: Aug. 10, 2010

(54) APPARATUS AND METHOD FOR COATING PRINTED SHEETS

(76) Inventor: Max W. Dahlgren, c/o Epic Products International Corp. 2801 E. Randol Mill Rd., Arlington, TX (US) 76011

( * ) Notice: Subject to any disclaimer, the term of this patent is extended or adjusted under 35 U.S.C. 154(b) by 679 days.

(21) Appl. No.: 11/717,685

(22) Filed: Mar. 14, 2007

(65) Prior Publication Data

US 2008/0063785 A1 Mar. 13, 2008

Related U.S. Application Data

(60) Provisional application No. 60/781,758, filed on Mar. 14, 2006.

(51) Int. Cl.
*B05C 11/00* (2006.01)

(52) U.S. Cl. ..... 118/676; 118/675; 118/682; 118/695; 118/696; 118/704

(58) Field of Classification Search ..... 118/676, 118/682, 695, 696, 704, 712, 675, 249, 258, 118/210, 46; 101/424.2
See application file for complete search history.

(56) References Cited

U.S. PATENT DOCUMENTS 5,964,155 A * 10/1999 Platsch ..... 101/424.2

* cited by examiner

*Primary Examiner*—Brenda A Lamb
(74) *Attorney, Agent, or Firm*—Buchanan Ingersoll & Rooney PC

(57) ABSTRACT

Printed sheets are delivered from a printer to a coating machine which feeds the sheets successively to a coating nip formed between a coating cylinder and an impression cylinder. A transport mechanism advances the sheets through the coating nip. The arrival of each sheet is sensed, and a control unit determines a speed necessary for each sheet to be initially fed in order to reach the coating nip simultaneously with an image area of the coating cylinder and with grippers of the transport mechanism, as well as at a speed equal to a surface speed of the coating cylinder. Independently driven rollers advance each sheet at that sheet's determined speed (e.g., acceleration or deceleration).

7 Claims, 7 Drawing Sheets

APPARATUS AND METHOD FOR COATING PRINTED SHEETS

This application claims priority under 35 U.S.C. §119 and or §365 to U.S. Provisional Application Ser. No. 60/781,758 filed on Mar. 14, 2006.

BACKGROUND

The present invention relates to an apparatus and method for coating printed sheets.

In recent years, high speed digital printing systems have been introduced with the capacity to produce high quality images on sheets of various sizes and at various sheet rates. Such a system is exemplified by the Xerox DucuColor iGen3™ digital production press. This system is capable of handling multiple sheet sizes and can produce up to 6000 impressions per hour or more. A need exists for providing high quality coatings on the printed sheets as they are being produced by such printers, e.g., in order to protect the printed images.

Coating machines are known in which printed sheets are fed through a coating nip formed between a coating cylinder and an impression cylinder. Coating material is distributed to an image area of a coating cylinder, e.g., an image area formed by a coating plate mounted on the coating cylinder, and is applied to the sheets. It is important that the leading edges of the printed sheets be properly synchronized with the printing plate as the sheet enters the coating nip, in order to ensure that the printed image on the sheet is properly coated.

Ideally, the sheets would be sent to the coating apparatus upon exiting the printer. A problem exists, however, because printed sheets do not necessarily exit the printer at a constant cadence, or frequency, thus making it difficult to synchronize the leading edge of the sheet with the image area as the leading edge enters the coating nip.

Even if the sheets were to exit the printer at a constant cadence, the instant at which the sheets exit the printer cannot be predicted, so there may be no opportunity to set the timing of the coating cylinder to conform to sheet arrival.

Therefore, a need exists for a coating apparatus and method which enables sheets received by the coating apparatus, especially received at a non-uniform cadence or at unpredictable moments, to be properly synchronized with the image area of a rotating coating cylinder.

It would also be desirable for the printed sheet to arrive at the printer while traveling at a speed equal to the surface speed of the coating cylinder.

Preferably, it should be possible for such a coating apparatus and method to be adapted to coat sheets of different lengths.

Moreover, it is common, once printed sheets have been coated, to feed the coated side of the sheet beneath a curing device, such as one or more high-wattage ultraviolet or infrared lamps. In the event that a sheet was to become jammed beneath the curing device, heat from the lamps could cause the sheet to reach a temperature high enough to ignite the sheet. Thus, it would be desirable to minimize the chances for coated sheets to ignite.

SUMMARY OF THE INVENTION

Printed sheets are delivered from a printer to a coating machine which feeds the sheets successively to a coating nip formed between a coating cylinder and an impression cylinder. A transport mechanism advances the sheets through the coating nip. The arrival of each sheet at the coating machine is sensed, and a control unit determines a speed necessary for each sheet to be initially fed in order to reach the coating nip simultaneously with an image area of the coating cylinder and with grippers of the transport mechanism, as well as at a speed substantially equal to a surface speed of the coating cylinder. Independently driven rollers advance each sheet at that sheet's determined speed (e.g., acceleration or deceleration).

BRIEF DESCRIPTION OF THE DRAWING

The objects and advantages of the invention will become apparent from the following detailed description of a preferred embodiment thereof in connection with the accompanying drawing in which like numerals designate like elements.

DETAILED DESCRIPTION OF A PREFERRED EMBODIMENT

Figure 1A:
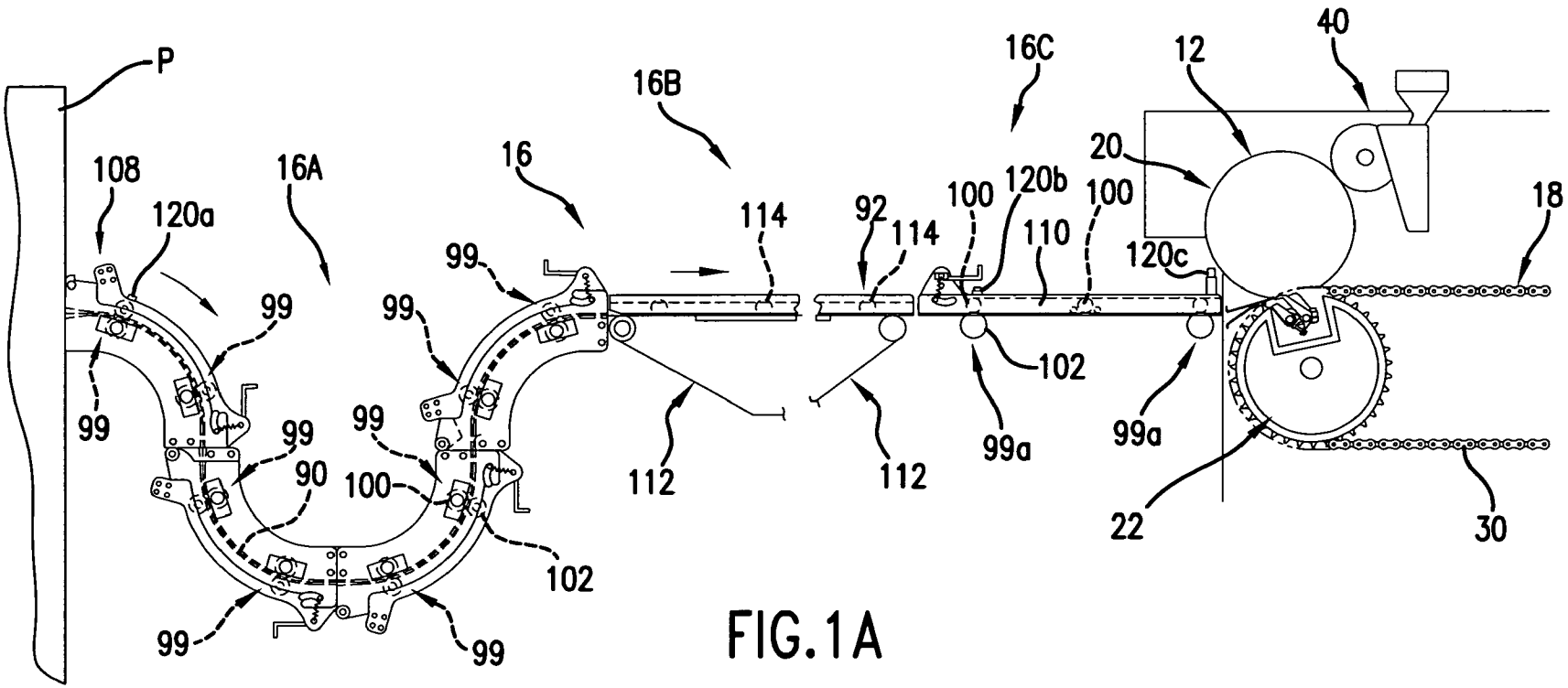
FIG. 1A is a side elevational view of a front portion of a coating machine according to the present invention.
Figure 1B:
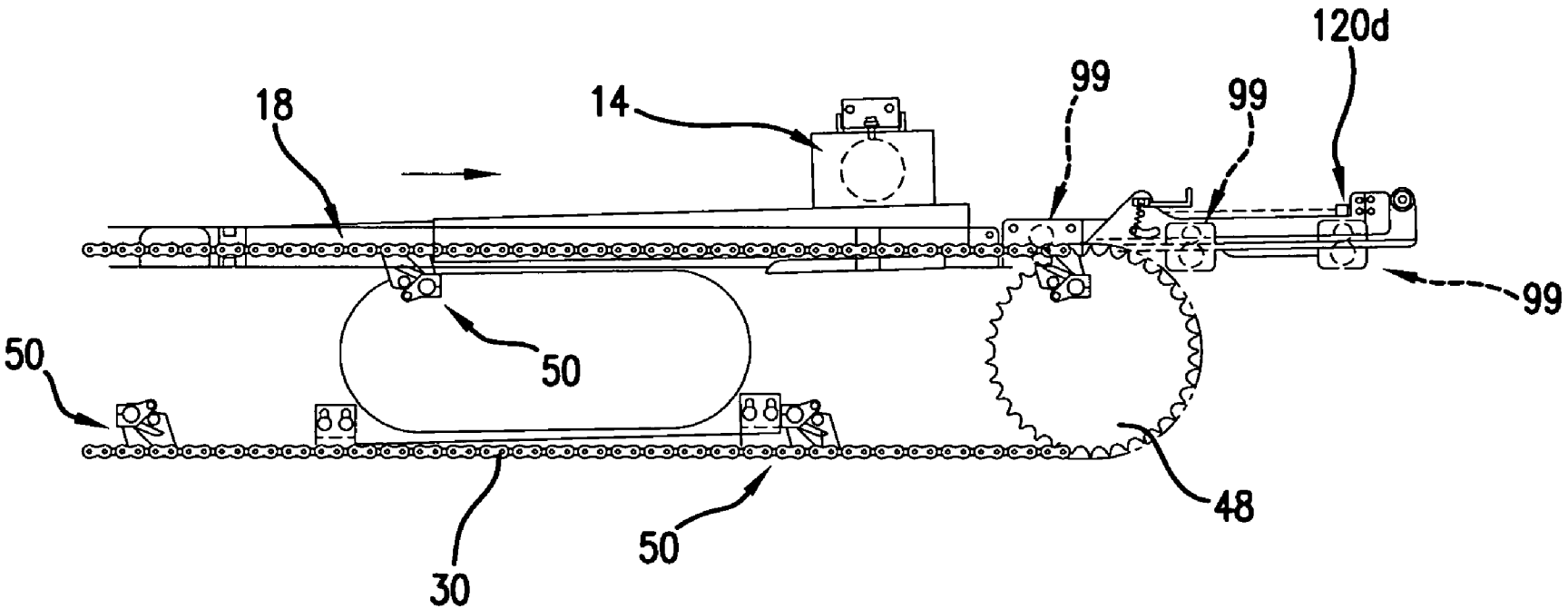
FIG. 1B is a side elevational view of a rear portion of the coating machine.

Depicted in FIGS. 1A and 1B are respective front and rear portions of a preferred coating apparatus 10 according to the invention. That apparatus includes a coating section 12 for coating sheets, a curing section 14 located downstream of the coating section for curing the coating material (see FIG. 1B), and a sheet feeding section 16 for feeding sheets to the coating section. The sheets could be formed of paper, plastic or other materials.

Common to the coating section 12 and the curing section 14 is a conventional sheet transporting mechanism 18 which receives sheets from the downstream end of the sheet feeding section 16 and transports them sequentially through the coating section 12 and the curing section 14.

Figure 4:
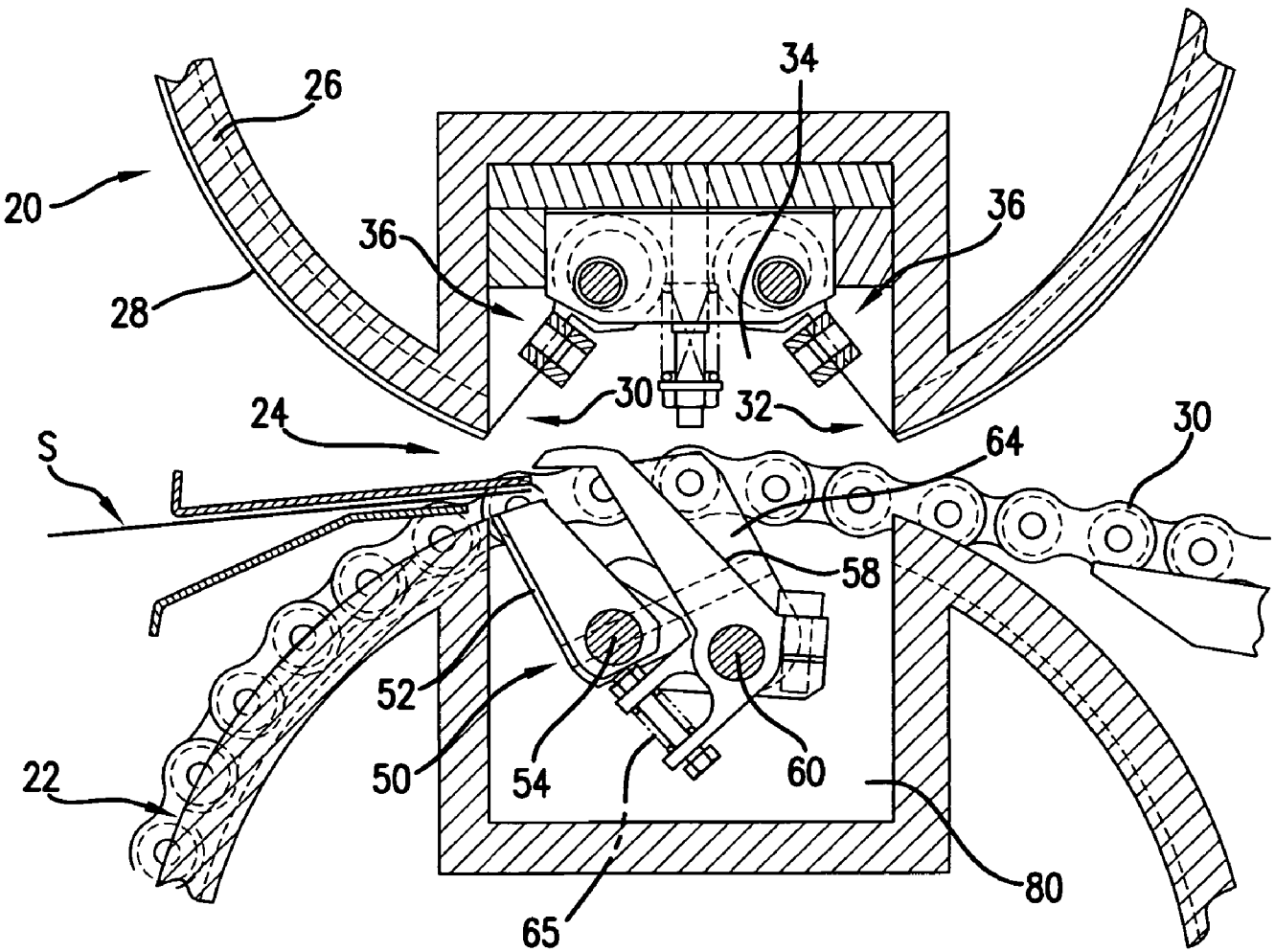
FIG. 4 is an enlarged fragmentary view of a coating nip of the coating machine.

The coating section 12 is conventional and includes a coating cylinder 20 and an impression cylinder 22 together forming a coating nip 24 (see FIGS. 1A and 4). The coating cylinder is conventional and includes a base cylinder 26 on which a coating plate 28 is mounted. Leading and trailing ends 30, 32 of the coating plate are secured in a recess 34 of the cylinder base by suitable fastening devices 36.

The coating plate 28 has an image area designed to coat sheets of a particular size. If different size sheets are to be coated, the coating plate would be replaced by a different coating plate having a different image area suited to that different size sheet.

The coating plate is supplied with liquid coating material by a suitable conventional applicator apparatus 40.

Figure 2:
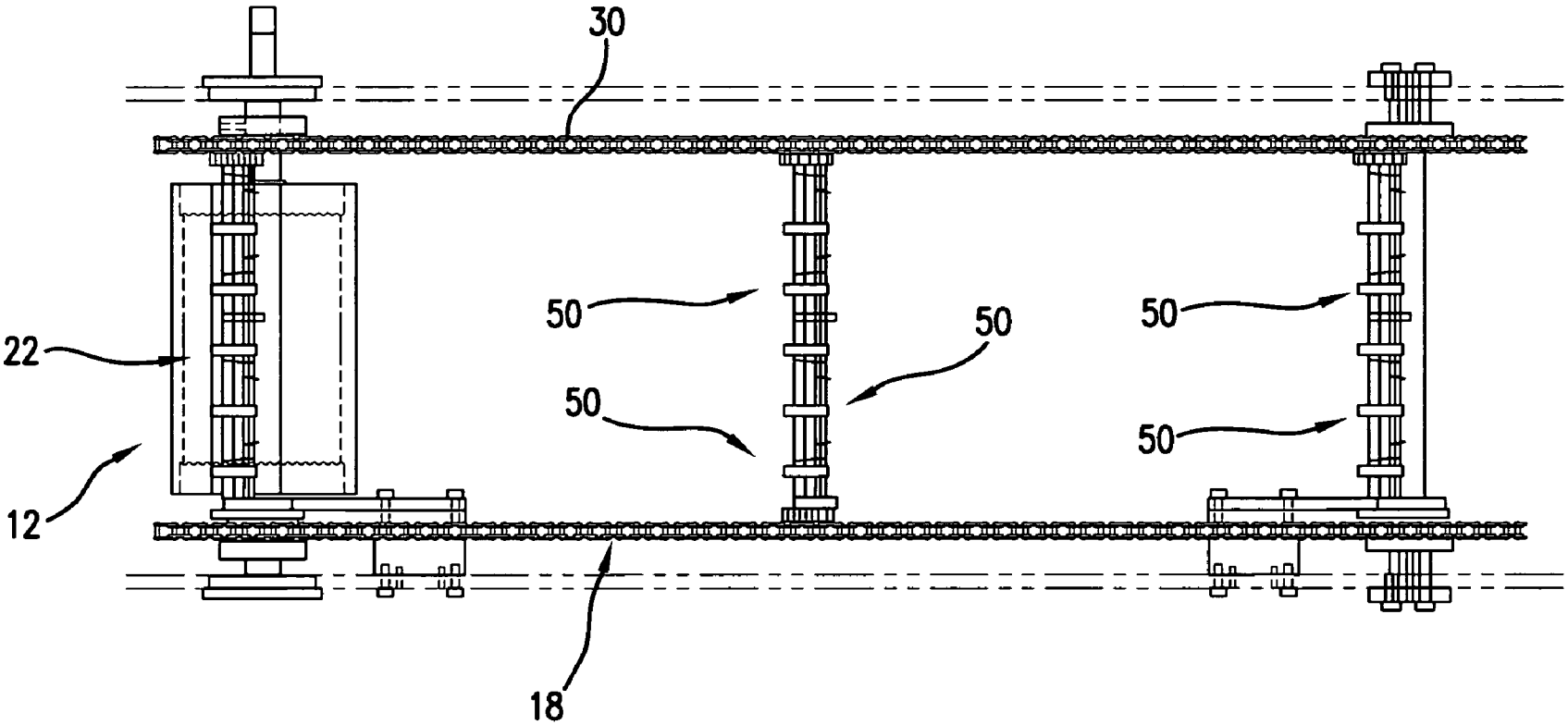
FIG. 2 is a top plan view of a portion of the printing machine, showing an impression roller and a sheet transport mechanism.

In order to advance sheets through the coating section 12 and the curing section 14, the sheet transporting mechanism 18 is provided which is conventional and includes a driven endless chain 30 wrapped around two sprocket wheels 46, 48. Those sprocket wheels are spaced apart in the direction of sheet travel and rotate about parallel horizontal axes. The chain carries suitable sheet-gripper elements 50, such as the ones shown in FIG. 4. The gripper elements are arranged in the form of lateral rows of gripper elements, wherein the rows are spaced longitudinally apart in the direction of sheet travel. Thus, one gripper element of a row of gripper elements is shown in FIG. 4, and the gripper elements of that row are spaced apart in a direction perpendicular to the direction of sheet travel, as shown in FIG. 2.

Each row of gripper elements is operable to grip the leading edge of a sheet S (see FIG. 4), and pull the sheet through the coating nip and past the curing device. Each row of gripper elements reaches the inlet of the coating nip, synchronously with the leading end of the image area of the coating plate 28 and synchronously with the leading edge of a printed sheet.

The gripping elements 50 can assume any suitable configuration, but preferably conventional gripping elements 50 are used, each of which comprises a pair of gripping fingers 52, 58 adapted to grip a sheet (see FIG. 4). A first finger 52 of each pair is fixedly mounted on a first gripper bar 54, the ends of which are fixedly mounted in respective ones of laterally spaced plates 64 (only one shown in FIG. 4) that are attached to the chain. The bar 54 extends perpendicularly to the direction of sheet feed. The second finger 58 of each pair of fingers is fixedly mounted on a second gripper bar 60 whose ends are also mounted in the plates 64. The bar 60 extends parallel to the first gripper bar. The second gripper bar is rotatably mounted in the plates 64. A coil spring 65 acts to bias each of the second fingers 58 and the second gripper bar in a direction causing the tips of the second fingers 58 to abut anvil surfaces of respective first fingers 52.

A fixed cam (not shown) is arranged laterally outside of the coating cylinder and is engaged by a cam follower (not shown) that is fixed to the second gripper bar 60 to cause that bar 60 to rotate about its axis, causing the tips of the second fingers 58 to rise off the anvil surfaces of the first fingers 52 and form a sheet-receiving gap therebetween, as shown in FIG. 4. That is done when the row of gripper elements reaches the inlet of the coating nip in order for the leading end of a sheet to enter the sheet-receiving gap between the fingers. Then the cam follower disengages from the cam to enable the springs 65 to rotate the second fingers 58 back toward the first fingers for gripping the sheet.

It will be appreciated that when each row of gripper elements passes through the coating nip 24, the gripper elements 50 will be situated within radially aligned recesses 34, 80 formed respectively in the coating cylinder and the impression cylinder.

The coating cylinder and the drive sprocket of the chain 30 are synchronously driven by respective gears (not shown) that mesh with a gear that drives the impression cylinder, the latter gear being driven. Thus, the respective recesses 34, 80 of the printing cylinder and the impression cylinder are always aligned radially with one another during each 360° rotation of the printing and impression cylinders, and a row of gripper elements always travels within those recesses during each such 360° rotation.

As pointed out earlier, the coating apparatus is disposed adjacent a printer P in order to coat the printed surfaces of sheets as the sheets exit the printer. Some of the successive sheets may not exit the printer at a constant frequency or cadence, due to particular operating characteristics of the printer. Even if the sheets were to exit the printer at a constant cadence, the moment of exiting may not be sufficiently predicable to enable the timing of the coating cylinder to be properly synchronized with sheet arrival. That means that if the sheets were conveyed directly to the coating nip, some of the sheets would reach the coating nip 24 non-synchronously with the gripper elements 50 and the image area of the coating cylinder. In order to ensure that all of the successive sheets will be properly coated by reaching the coating nip synchronously with the leading end of the image area and thus synchronously with a respective row of gripper elements, the present invention contemplates a unique sheet-feeding mechanism which feeds successive sheets at respective speeds calculated to ensure that each sheet reaches the coating nip synchronously with a respective row of gripper elements, and at a speed equal to the surface speed of the coating cylinder.

Figure 3:
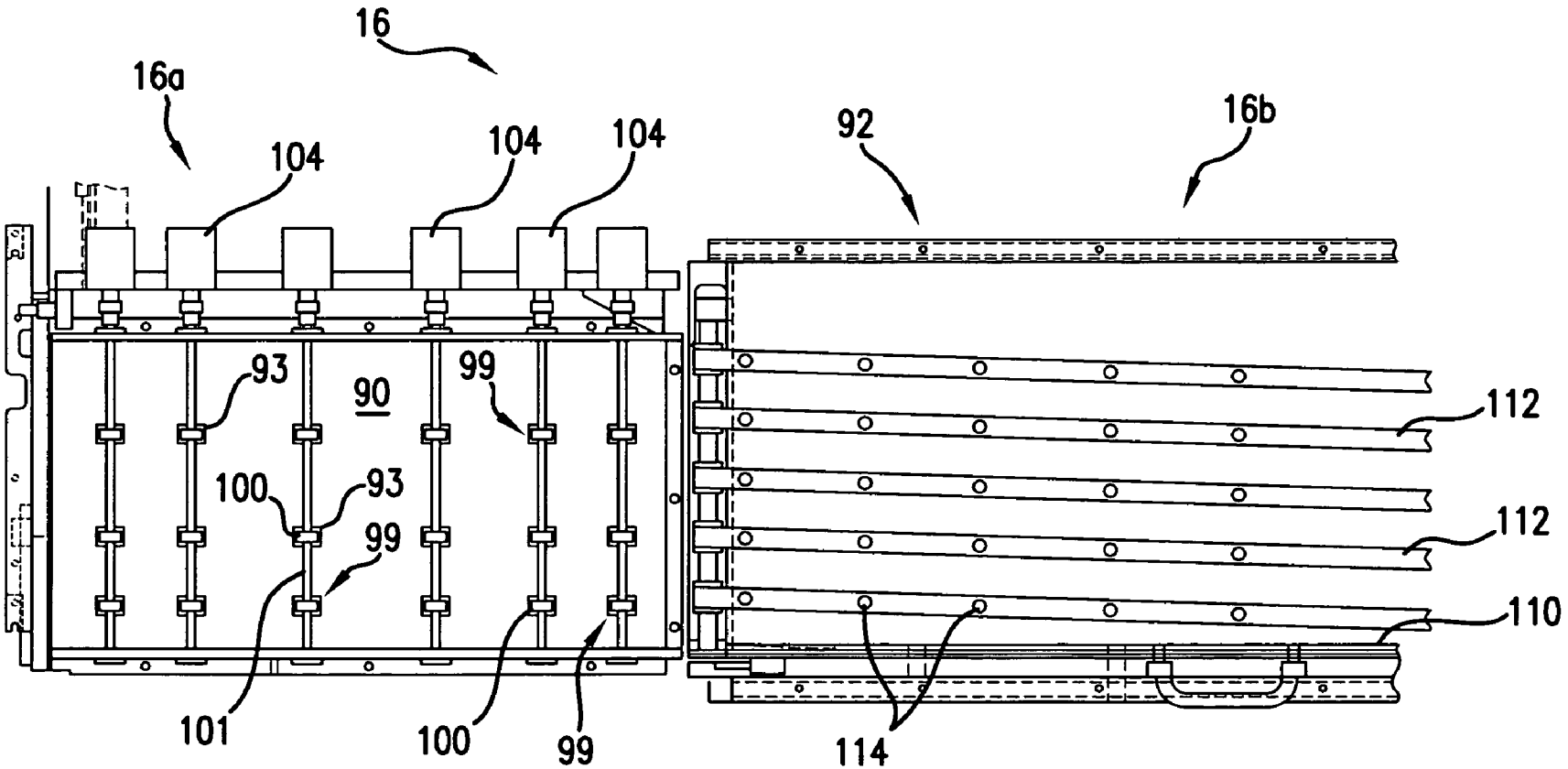
FIG. 3 is a top plan view of part of the front portion of the coating machine.

The feeding section 16 comprises first, second and third portions 16A, 16B, and 16C arranged successively in the direction of feed. The first portion 16A comprises a generally U-shaped guide surface 90 along which the sheets travel, and preferably also includes a side guide table 92 extending from a location adjacent a downstream end of the guide surface 90 to a location adjacent the inlet of the coating nip (see FIGS. 1A and 3).

The guide surface 90 includes a plurality of recesses 93 (FIG. 3) which accommodate pairs 99 of pinch rollers 100, 102 each having a relatively soft outer surface. The pairs of pinch rollers are arranged in transverse rows that are spaced apart in the direction of sheet feed. The top rollers 100 of each row of pinch rollers are mounted on a common transverse top shaft 101, and the bottom rollers 102 of each row of pinch rollers are mounted on a common transverse bottom shaft. With reference to each row of pinch rollers, either the top rollers 100 or the bottom rollers 102 thereof are driven, and the driven rollers of each row are driven independently of the driven rollers of all other rows. The driving of the rollers is accomplished by driving the common shaft thereof preferably by a conventional electric stepper motor 104 (see FIG. 3). Each row of driven rollers is driven independently of the other rows of driven rollers to enable the sheets to be individually accelerated or decelerated at respective rates under the control of a control unit 106, to which each stepper motor 104 is connected, as will be discussed.

The guide surface 90 in the preferred embodiment is U-shaped as viewed from the side (see FIG. 1A), wherein the U-shaped curvature is open in an upward direction. Thus, the sheets are fed along a corresponding U-shaped path. The reason for such a shape is to minimize the horizontal length of the apparatus, but it would be alternately feasible for the guide surface to be planar instead of curved.

The second portion 16B of the feeding section operates under conventional principles to advance the sheets at a substantially constant rate of speed while directing one edge of each sheet transversely toward and against a vertical alignment surface 110 so that those edges of all sheets are longitudinally aligned when entering the coating nip. The portion 16B comprises a side guide table 92 which includes spaced endless conveyor belts 112 on which the sheets are fed between the belts and freely rotatable hold-down rollers or balls 114 located above the belts. The belts are driven (toward the right in FIG. 3) such that the travel direction of the upper flight of each belt is slightly skewed generally laterally toward the vertical alignment surface. As the sheets are advanced, they gradually move into contact with the vertical guide surface 110.

The third portion 16C of the feeding section comprises additional pairs of nip rollers 99*a* to be discussed.

A plurality of sheet sensors 120*a*-120*c* is provided along the feed path of the feeding mechanism, the sensors preferably comprising conventional LED optical sensors, although any suitable sensors could be used. An initial sensor 120*a* is disposed near the inlet 108 of the feeding mechanism just downstream of a first row of the pinch rollers in order to sense the leading edge of a printed sheet that has entered the inlet 108 and thus has broken the beam of the sensor 120*a*.

Figure 6:
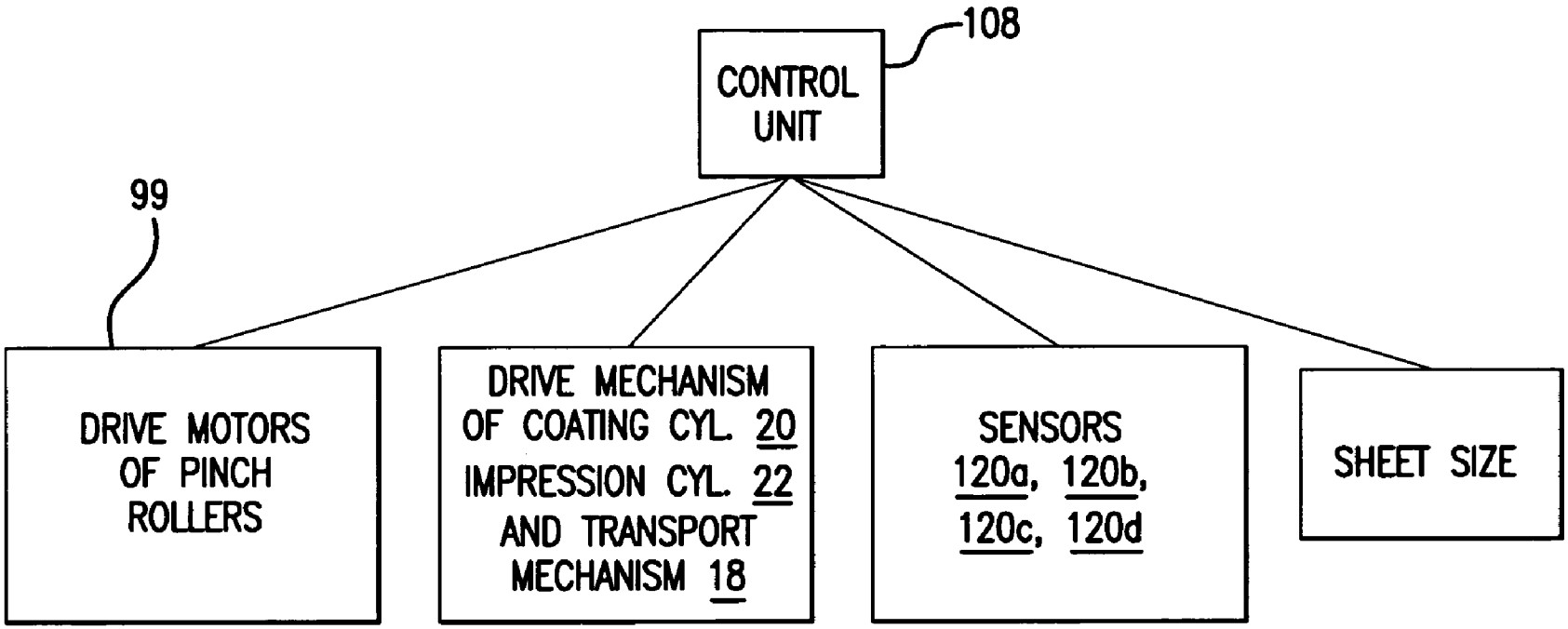
FIG. 6 is a schematic view of a control mechanism for the coating apparatus.

In response to the initial sensor 120*a* sensing the arrival of a printed sheet, a signal indicative of such arrival is provided to the control unit 106. As can be seen in FIG. 6, the control unit also receives signals from the drive mechanism that drives the coating cylinder, the impression cylinder, and the transport chain 30, which signals are indicative of the angular position of the coating plate relative to the coating nip, (and thus also of the location of the rows of gripper elements 50 relative to the coating nip). Since the distance from the initial sensor 120*a* to the coating nip is fixed and known to the control unit, as are the respective constant speeds at which the coating cylinder and the belts of the side guide table are traveling, the control unit 106 can calculate a speed (e.g., acceleration or deceleration) for each sheet in order for the sheet to reach the coating nip simultaneously, i.e., in synch, with the arrival of the leading end of the image area of the coating plate and thus with a row of gripper elements (hereafter referred to as the "synchronous arrival"), as well as at a speed equal to the surface speed of the coating cylinder. In that regard, it will be appreciated that the first portion 16A of the feeding section constitutes a variable-speed portion of the feeding section, whereas the second portion 16B constitutes a constant-speed portion of the feeding mechanism.

Since the driven ones of the pinch rollers are independently driven, they can be driven at suitable speeds for achieving the required acceleration/deceleration of each individual sheet.

Of course, multiple successive sheets will be fed simultaneously by the feeding mechanism, the respective positions of the sheets being known to the control unit since the control unit was informed as to the arrival of each sheet by the initial sensor 120*a*, and since the speed of each sheet along the feeding mechanism is known by the control unit which has determined those speeds. Thus, the control unit is able to independently control the simultaneous feeding of a plurality of sheets. The main speed adjustment will be made as the sheets are fed along the guide surface 90.

Due to tolerances occurring during the feeding of the sheets, however, it is possible that a sheet will not achieve the previously-described synchronous arrival at the coating nip when fed at the initial speed established by the control unit. Accordingly, there is provided at least one, but preferably multiple additional sensors 120*b*, 120*c* in the third portion 16C of the feeding section 16 for sensing an updated location of each sheet to enable the control unit to establish an updated feeding speed for the sheet in order to achieve the simultaneous arrival, and for the sheet to be traveling at a speed equal to the coating cylinder's surface speed. In the preferred embodiment, two additional sensors 120*b*, 120*c* are provided, both situated between the coating nip 124 and a downstream end of the side guide table 92. A first one 120*b* of the additional sensors is situated immediately downstream of the side guide table 92 and slightly downstream of a nip created by one of the pairs 99*a* of pinch rollers driven by an electric stepper motor (not shown) and which feed the sheets downstream of the belts 112.

As a leading edge of a sheet is sensed by the sensor 120*b*, a corresponding sheet-position signal is supplied to the control unit which then determines an updated speed for feeding that particular sheet in order to achieve the previously described synchronous arrival at the coating nip. That can be done since the distance from the sensor 120*b* to the coating nip is known to the control unit, as is the angular position of the coating plate and the location of the gripper elements. The updated speed could be the same as, or different from, the initial speed previously established for that sheet.

The second additional sensor 120*c* is located immediately upstream of the coating nip and just downstream of a pair 99*c* of pinch rollers driven by an electric stepper motor. Thus, the control unit is able to make one final adjustment in the sheet speed, if necessary, in order to achieve the previously-described synchronous arrival at the coating nip, and for the sheet to be traveling at the same speed as the coating cylinder's surface speed.

Significantly, each of the sensors 120*a*, 120*b*, 120*c* is located just downstream of its respective pair of pinch rollers. Consequently, each sheet will be under the control of such pair of pinch rollers at the instant that sensing occurs, enabling a sheet speed adjustment to be instantly initiated.

A further advantage resulting from the present invention involves the curing of the coating that has been applied to the sheets. The curing device 14 of the curing section preferably comprises a conventional high-wattage ultraviolet or infrared unit which cures the applied coating as the coated side of the sheet is passed beneath the curing device by the sheet transport mechanism 18. It will be appreciated that in the event a flammable sheet, such as paper, were to become jammed beneath the curing device, the sheet could become excessively heated and consequently could ignite, thereby presenting a hazard to surrounding personnel and to the apparatus itself.

To deal with that problem, an additional sheet sensor 120*d* is located downstream of the curing device 14 (see FIG. 1B). Since the control unit is aware of the entry of all sheets into the coating nip as well as the constant speed of the gripper elements, and the fixed distance between the coating nip and the sensor 120*d*, the control unit can predict when each sheet should reach the sensor 120*d*. In the event that the sheet arrives later than the predicted time by a predetermined amount, it can be assumed that the sheet has been stopped, e.g., jammed, somewhere between the coating nip and the sensor 120*d*, possibly beneath the curing device. Thus, as a safety precaution, the control unit would operate to de-energize the curing device in order to minimize the risk of a sheet being ignited by the curing device.

It is necessary to provide the control unit with information as to the sheet length being coated in each coating run, so that a proper spacing can be maintained between successive sheets as they are fed to the coating nip. In the event that sheets of different size are to be coated, the image area of the coating cylinder will be changed, e.g., the coating plate 28 will be replaced by a different coating plate having an image area suited to the different sheet size. Also, the control unit will be advised of the new sheet length being run.

Figure 5:
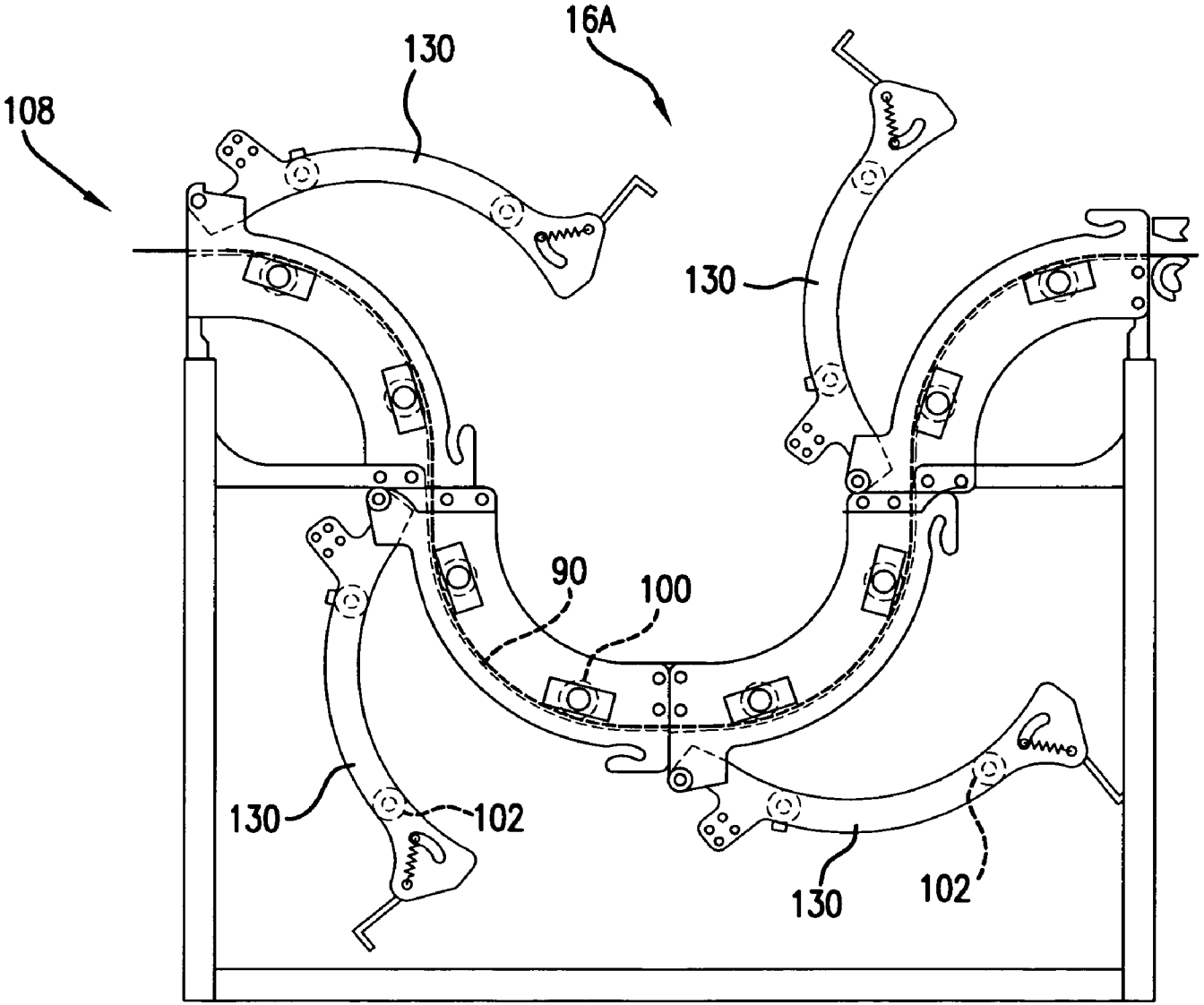
FIG. 5 is a side elevational view of part of the front portion of the coating machine, showing the elements thereof in an opened-up state.

In order to facilitate access to various parts of the apparatus, some of the rollers of the pairs of pinch rollers can be mounted on pivoted carriers 130 as shown in FIG. 5 which can be opened to expose parts of the apparatus.

It will be appreciated that the present invention enables printed sheets, especially printed sheets that are emitted in a non-constant cadence from a printing machine, to be delivered to a coating cylinder synchronously with movements of an image area and sheet transport grippers, to ensure that accurate coating is achieved.

Also, the risk of flammable sheets being ignited in the curing section is minimized, since the possible presence of a jammed sheet can be detected, in order to de-energize the curing device.

In lieu of locating the side guide table 92 downstream of the guide surface 90 and its associated pinch rollers and sensors, the side guide table could be located upstream of the guide surface 90.

Although the present invention has been described in connection with a preferred embodiment thereof, it will be appreciated by those skilled in the art that additions, deletions, modifications, and substitutions not specifically described may be made without departing from the spirit and scope of the invention.

What is claimed is:

1. A coating machine for applying a coating to printed sheets, comprising:

a coating cylinder having an image area thereon;

an impression cylinder disposed opposite the coating cylinder for defining therewith a coating nip;

a transport mechanism for advancing printed sheets successively through the coating nip;

a drive mechanism for driving the transport mechanism synchronously with the coating cylinder and the impression cylinder;

a feeding mechanism for feeding printed sheets from an inlet to the coating nip, comprising:

driven rollers spaced apart along a direction of sheet feed for feeding sheets toward the coating nip, the spaced apart driven rollers being driven independently of one another by respective motors, and a first sensor for sensing the arrival of successive printed sheets and providing therefrom respective initial sheet position signals, and a second sensor spaced downstream from the first sensor and upstream from the coating nip, for sensing successive sheets being fed and providing therefrom respective updated sheet position signals; and a control unit connected to the independently driven motors, the first and second sensors, and the drive mechanism of the transport mechanism, for receiving the initial and updated sheet position signals to determine therefrom initial and updated speeds for feeding the individual sheets in order for each sheet to arrive at the coating nip synchronously with both the transport mechanism and the image area of the coating cylinder and at a speed substantially equal to a surface speed of the coating cylinder, and for independently driving the motors for feeding each sheet at its respective initial and updated speeds.

2. The coating machine of claim 1 wherein the transport mechanism comprises rows of pinch roller pairs, each row extending transversely of the direction of feed, each pinch roller pair including a variable-speed driven roller, wherein the driven pinch rollers of one row are drivable independently of the driven pinch rollers of other rows.

3. The coating mechanism of claim 2 wherein each of the first and second sensors controls the speed of respective rows of driven pinch rollers, and is disposed downstream of such respective row, wherein each sheet is under the control of a respective row when its position is sensed.

4. The coating machine of claim 2 wherein the feeding mechanism comprises a first section for feeding the sheets along a generally U-shaped path.

5. The coating machine of claim 4 wherein the feeding mechanism comprises a second section disposed downstream of the first section for feeding the sheets along a straight path.

6. The coating machine of claim 1 further including a curing device disposed downstream of the coating cylinder for applying heat to successive sheets.

7. The coating machine of claim 6 further including a sensor disposed downstream of the curing device for providing a signal to de-energize the curing device in response to the failure of sensing a sheet at an expected time determined by the control unit.

* * * * *